US008302888B2

(12) United States Patent
Burger et al.

(10) Patent No.: US 8,302,888 B2
(45) Date of Patent: Nov. 6, 2012

(54) FUEL INJECTOR

(75) Inventors: Matthias Burger, Murr (DE); Hans-Christoph Magel, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 307 days.

(21) Appl. No.: 12/686,606

(22) Filed: Jan. 13, 2010

(65) Prior Publication Data

US 2010/0175665 A1 Jul. 15, 2010

(30) Foreign Application Priority Data

Jan. 13, 2009 (DE) ..... 10 2009 000 181

(51) Int. Cl.
*F02M 61/10* (2006.01)
*F02M 51/00* (2006.01)

(52) U.S. Cl. ..... 239/585.5; 239/533.2; 239/533.11

(58) Field of Classification Search ..... 123/467; 239/585.1, 585.2, 585.3, 585.4, 585.5, 533.5, 239/533.7, 533.2, 533.11
See application file for complete search history.

(56) References Cited

U.S. PATENT DOCUMENTS

| | | | | |
|---|---|---|---|---|
| 6,811,134 | B2 * | 11/2004 | Stoecklein et al. | 251/57 |
| 7,926,737 | B2 * | 4/2011 | Stoecklein et al. | 239/96 |
| 7,946,509 | B2 * | 5/2011 | Boecking | 239/125 |
| 2003/0052198 | A1 * | 3/2003 | Tappolet et al. | 239/533.3 |
| 2005/0263135 | A1 * | 12/2005 | Magel et al. | 123/467 |
| 2008/0093484 | A1 * | 4/2008 | Stoecklein et al. | 239/585.5 |
| 2009/0065614 | A1 * | 3/2009 | Ganser | 239/584 |
| 2011/0139906 | A1 * | 6/2011 | Burger et al. | 239/569 |

FOREIGN PATENT DOCUMENTS

| | | | |
|---|---|---|---|
| DE | 102007014359 | A1 | 3/2008 |
| DE | 102007001363 | A1 | 7/2008 |
| EP | 0690223 | A2 | 1/1996 |
| WO | 9949209 | A1 | 9/1999 |

* cited by examiner

*Primary Examiner* — Thomas Moulis
(74) *Attorney, Agent, or Firm* — Michael Best & Friedrich LLP

(57) ABSTRACT

The invention relates to a fuel injector, in particular a common rail injector, for injecting fuel into a combustion chamber of an internal combustion engine. The fuel injector has a multi-part injection valve element, which is adjustable between a closing position and an opening position and includes a first part and at least one second part that is adjustable relative to the first part. The first and second parts are coupled to one another via a hydraulic coupler volume. According to the invention, it is provided that the first part is guided in the second part, or the second part is guided in the first part, and that the coupler volume communicates with an injector volume via at least one throttle arrangement. The throttle arrangement is embodied such that the volumetric through flow increases only disproportionately little with an increasing pressure difference between the coupler volume and the injector volume.

19 Claims, 2 Drawing Sheets

1
17
16
42
40
3
2
4
5
47
39
36
35
46
34
33
32
6
30
41
37
38
28
29
31
7
9,10
45
43
8
44
11
18
24
52
12
51
50
49
48
23
53
12
13,22
21
19
14
26
27
15
25

FUEL INJECTOR

CROSS-REFERENCE TO RELATED APPLICATION

This application is based on German Patent Application 10 2009 000 181.6 filed Jan. 13, 2009.

BACKGROUND OF THE INVENTION

1. Field of the Invention

The invention relates to a fuel injector, in particular a common rail injector, for injecting fuel into a combustion chamber of an internal combustion engine.

2. Description of the Prior Art

The highest priority in the development of internal combustion engines is devoted to adhering to pollutant limit values. Precisely the common rail injection system has made a decisive contribution to reducing pollutants. The advantage of common rail systems is their independence of the injection pressure on the rpm and load. For meeting future exhaust gas limit values, however, a significant increase in the injection pressure is necessary precisely with Diesel engines.

Stroke-controlled common rail injectors are known whose injection valve element is servo-operated. Piezoelectric and magnet valves are used as pressure adjusters and with them the servo circuit is controlled. For fast needle closure, a permanent low-pressure stage is often provided, which exerts a permanent closing hydraulic force on the needle. The disadvantage is the high amount of leakage that ensues between the high-pressure and the low-pressure stage. Leakage unavoidably leads to the necessity of higher pumping power and thus to sacrifices in system efficiency. This situation becomes especially problematic at high pressures. For that reason, the latest injectors are designed to be leak-free at extremely high injection pressures.

In contrast to conventional designs, these so-called leak-free fuel injectors have no permanent low-pressure stage acting in the closing direction, and as a result the attendant leakage points are eliminated. Because of the eliminated low-pressure stage, two-part injection valve elements of the kind used in the fuel injectors with a low-pressure stage that are used in the industry are no longer employed.

While in modern mass-production injectors with a low-pressure stage, both injection valve element parts (control rod and nozzle needle) are pressed against one another because of the resultant pressure forces, in the case of leak-free fuel injectors a separate form- or force-locking connection must be established. For coupling to injection valve elements, it has become known to provide a hydraulic coupler volume between them. The coupler volume is typically realized in the form of a coupler sleeve in which one of the injection valve element parts is guided. The coupler volume is reduced by expelling fuel through the guide gap between the injection valve element part guided in the sleeve and the sleeve itself.

OBJECT AND SUMMARY OF THE INVENTION

It is the object of the invention to propose a fuel injector of simple construction, in which the coupling of the at least two injection valve element parts is achieved with the least possible number of components.

The invention is based on the fundamental concept of guiding two parts, adjustable relative to one another, of the injection valve element one inside the other, so that it is possible to dispense both with a separate guide sleeve of the kind used in the prior art and a spring subjecting the guide sleeve to spring force. In contrast to the provision of a long, one-piece injection valve element, the at least two-part, and preferably solely two-part, embodiment has the advantage that the production of the individual injection valve element parts is less complicated overall and is thus more economical than the production of a long, one-piece injection valve element. Moreover, existing production lines can be retained along with the existing logistics that are directed to a multi-part injection valve element.

The invention has furthermore recognized the fact that in a version with injection valve element parts guided inside one another, a constant increase in the coupler volume during fuel injector operation would occur if the coupler volume were in communication with an injector volume solely via a guide gap between the two parts, since the flow resistance of the guide gap varies in proportion to the pressure difference applied. The fact that the flow resistance of such a guide gap is in a linear relationship to the magnitude of the pressure difference between the coupler volume and the injector volume would have the result that upon opening of the fuel injector, because of the very low pressure in the coupler volume, a very large amount of fuel would be aspirated from the injector volume, and evacuating the coupler volume in the closing operation would no longer be possible because of the (short) time available. In an extreme case, this would lead to axial wedging of the injection valve element in the fuel injector and thus to a displacement of the fuel injector. To avoid such an effect, in a fuel injector embodied in accordance with the concept of the invention, the coupler volume is made to communicate with the injector volume via at least one throttle arrangement, in addition to or as an alternative to a guide gap, and the throttle arrangement is embodied such that the volumetric fuel flow (flowthrough volume flow) flowing through the throttle arrangement does not vary in proportion to the pressure difference between the coupler volume and the injector volume as in the case of a guide gap but instead varies disproportionately little.

Expressed in other terms, the flowthrough volume flow that flows through the throttle arrangement does not increase to the same extent as a pressure difference between the coupler volume and the injector volume; that is, the flowthrough volume flow and the pressure difference are not in a linear relationship. Expressed in still other terms, it is preferable if the increase in the flowthrough volume flow becomes less and less as the pressure difference becomes greater and greater. Ideally, the flowthrough volume flow is proportional to the root of the pressure difference between the injector volume and the coupler volume.

In a fuel injector embodied in accordance with the concept of the invention, it is attained that even if there is an extremely great pressure difference between the coupler volume and the injector volume at the onset of the opening event, only a moderate fuel quantity is aspirated through the throttle arrangement into the coupler volume, and the time during the closing event when the injection valve element is moved in the direction of the injection valve element seat, preferably by means of a closing spring, suffices for the previously aspirated coupler volume to be dispensed again by the throttle arrangement into the injector volume in order to restore the original status.

One possibility for embodying the throttle arrangement is to provide at least one and preferably solely one throttle bore, made in particular in the first or the second part; very particularly preferably, the throttle bore is embodied on the order of an outflow throttle restriction from a control chamber, as in known servo circuit fuel injectors. Preferably, the throttle bore is accordingly a graduated bore with a diameter stage that preferably leads to the embodiment of a turbulent, cavitating flow inside the throttle bore.

The aforementioned diameter stage is one possibility for attaining a degressive ratio between the flowthrough volume flow, on the one hand, and the pressure difference between the coupler volume and the injector volume, on the other. In principle, arbitrary throttle stages, in particular hydraulically sharp-edged throttle stages, can be realized for the purpose, preferably with an only slight length in the flow direction. Preferably, the length of the at least one throttle stage is designed such that a turbulent flow develops. The term "hydraulically sharp-edged throttle stage" is understood to mean a length to the hydraulic diameter ratio of less than or equal to 10. For the hydraulic diameter of an annular gap throttle restriction, the following equation applies:

$$D_{Hyd} = 4 \cdot \frac{\text{flow cross section}}{\text{flow peripheral length}}.$$

The peripheral length in this equation is the sum of the inner and the outer peripheral length.

It is especially preferable if the throttle arrangement includes a plurality of throttle restrictions connected (disposed) hydraulically in series. Preferably, the throttle restrictions are embodied radially between the two injection valve element parts, preferably in the guide region with which the two parts are guided inside one another. As already indicated, it is especially preferred if the throttle restrictions are embodied in such a way, or in other words have such a slight length in the flow direction, that the guide length is so slight that a turbulent flow develops. If there were a laminar flow, the flowthrough volume flow through the throttle arrangement would be proportional to the pressure difference between the coupler volume and the injector volume, which is what is to be avoided here.

One possibility for embodying the throttle arrangement is to provide a plurality of grooves disposed axially side by side (parallel) on one of the injection valve element parts; the throttle restrictions are formed radially between the lands that define the grooves and the other injection valve element part. Preferably, the lands are at least approximately sharp-edged, in order to achieve a minimal guide length and thus to compel the development of a turbulent flow. Quite particularly preferably, in an embodiment with a plurality of throttle restrictions disposed axially one after the other in the flow direction, a throttle bore in the injection valve element parts is dispensed with.

An embodiment of the fuel injector in which the hydraulic coupler is embodied as a joint is especially expedient; this makes a certain pivotability of the two hydraulically coupled injection valve element parts possible so that in this way, tolerance-caused angular errors and skewed positions can be compensated for.

An especially preferable possibility for embodying such a pivot joint is to contour the guided injection valve element part spherically in the region of the guide in order to enable relative pivoting.

In a refinement of the invention, it is advantageously provided that the fuel injector is embodied as leak-free, except for possible leaks in the region of the control valve element. To that end, a low-pressure stage on the injection valve element that acts in the closing direction on the injection valve element is dispensed with.

BRIEF DESCRIPTION OF THE DRAWINGS

The invention will be better understood and further objects and advantages thereof will become more apparent from the ensuing detailed description of preferred embodiments taken in conjunction with the drawings, in which:

FIG. 2 shows a further exemplary embodiment of a fuel injector, in which two parts of an injection valve element are coupled hydraulically with one another in such a way that a throttle bore can be dispensed with.

DESCRIPTION OF THE PREFERRED EMBODIMENTS

Figure 1:
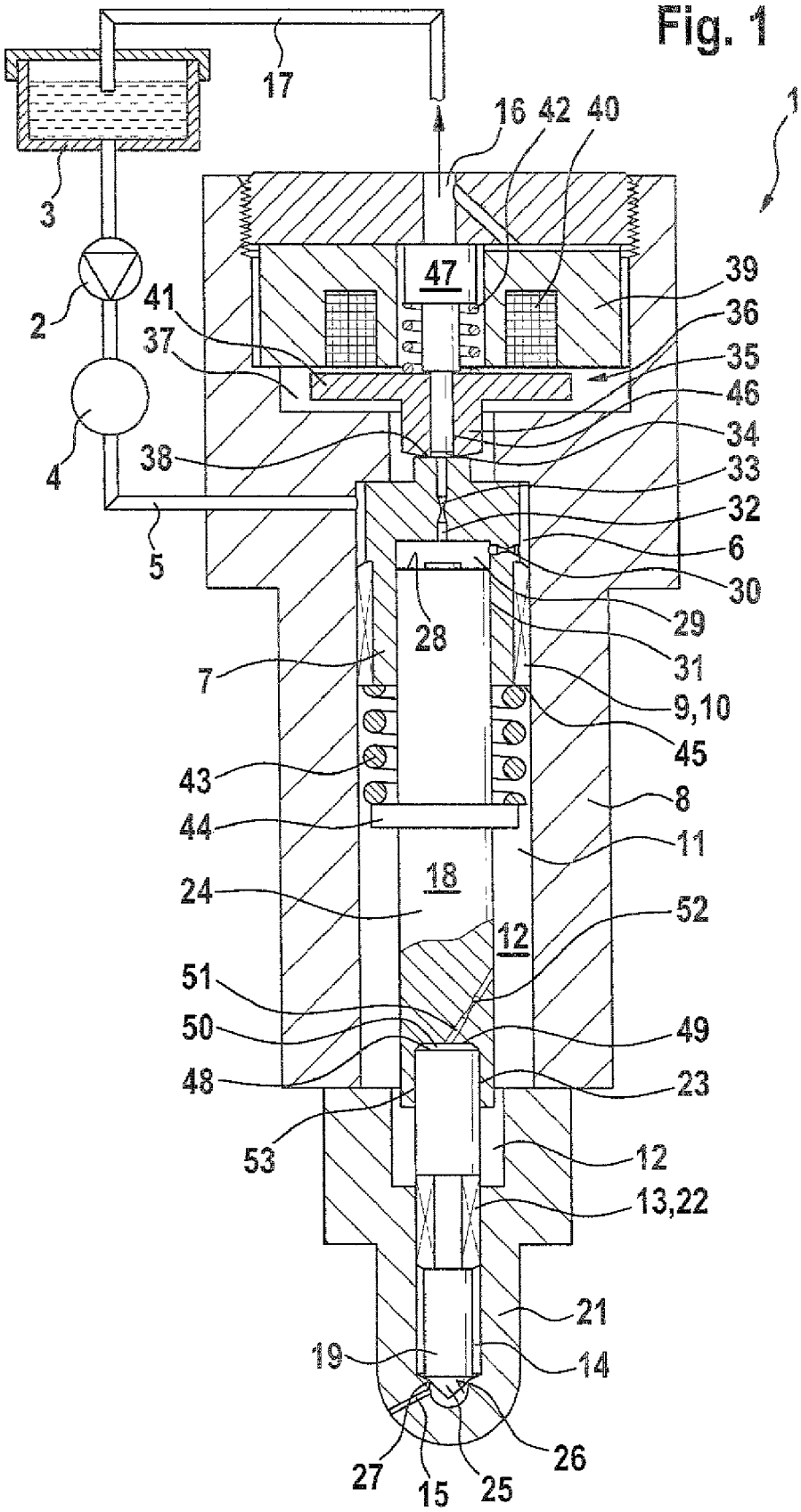
FIG. 1 shows a first exemplary embodiment of a fuel injector, in which two parts of an injection valve element are guided one inside the other and hydraulically coupled, and the coupler volume communicates with an injector volume via a throttle bore.

In the drawings, identical elements and elements with the same function are identified by the same reference numerals.

In FIG. 1, a fuel injector 1 embodied as a common rail injector is shown, for injecting fuel into a combustion chamber, not shown, of an internal combustion engine, also not shown, of a motor vehicle. A high-pressure pump 2 delivers fuel from a tank 3 into a high-pressure fuel reservoir 4 (rail). In this reservoir, fuel, especially Diesel or gasoline, is stored at high pressure, which in this exemplary embodiment is above 2000 bar. The fuel injector 1, along with other fuel injectors, not shown, is connected to the high-pressure fuel reservoir 4 via a supply line 5. The supply line 5 discharges into an annular chamber 6 between a valve body 7 and an injector body 8 (housing part). Via axial conduits 10, formed by polished sections 9 on the outer circumference of the valve body 7, the fuel which is at high pressure can flow essentially unthrottled in the axial direction downward in the plane of the drawing into a pressure chamber 11 functioning a mini-rail for minimizing pressure fluctuation. The pressure chamber 11 defines an injector volume 12. Upon an injection event, the fuel flows directly through axial conduits 13 into a nozzle chamber 14 (annular chamber), also belonging to the injector volume 12, and from that chamber through at least one injection port 15 into the combustion chamber of the engine. The fuel injector 1 is connected via an injector return connection 16 to a return line 17. Via the return line 17, a control quantity of fuel, to be explained hereinafter, can flow out from the fuel injector 1 to the tank 3 and from there can be delivered back to the high-pressure circuit.

What in this exemplary embodiment is a two-part injection valve element 18 is disposed axially adjustably inside the injector body 8. The injection valve element 18 protrudes with its lower, first part 19, embodied as a nozzle needle, into a graduated bore of a nozzle body 21. In that body, the first part 19 is guided axially displaceably with a guide portion 22. The axial conduits 13 are embodied radially between the first part 19 and the nozzle body 21 by means of polished sections 9 in the guide portion 22. The nozzle body 21 is screwed to the injector body 8 by means of a union nut, not shown.

The first part 19 (nozzle needle) of the injection valve element 18 is guided in a face-end blind bore 23 of a second part 24 (control rod) of the injection valve element 18.

As also shown in FIG. 1, the injection valve element 18, on a (lower) tip 25 embodied on the first part 19, has a closing face 26 (sealing face), with which the injection valve element 18 can be brought into tight contact with an injection valve element seat 27 embodied inside the nozzle body 21. When the injection valve element 18 is in contact with its injection valve element seat 27, or in other words is in a closing position, the fuel is blocked from emerging from the at least one injection port 15. Conversely, if the injection valve element 18 has lifted from its injection valve element seat 27, then fuel can flow out of the pressure chamber 11 via the axial conduits 13 and the nozzle chamber 14 embodied as an annular chamber, past the injection valve element seat 27, to the injection port 15 and there can be injected, essentially at the high pressure (rail pressure), into the combustion chamber.

A control chamber 29 is defined by an upper face 28 of the second part 24 of the injection valve element 18 and by a sleevelike portion, toward the bottom in the plane of the drawing, of the valve body 7 and is supplied with fuel at high pressure from the annular chamber 6 via an inlet throttle restriction 30 extending radially in the sleevelike portion of the valve body 7. The sleevelike portion with the control chamber 29 enclosed in it is surrounded radially on the outside by fuel at high pressure, so that an annular guide gap 31, radially between the sleevelike portion of the valve body 7 and the injection valve element 18, in this case the second part 24, is comparatively fuel-tight.

The control chamber 29 communicates via an axial conduit 32, extending perpendicular in the valve body 7 and having an outlet throttle restriction 33, with a valve chamber 34, which is defined radially on the outside by an axially adjustable, sleevelike control valve element 35 of a control valve 36 (servo valve) that is pressure-compensated in the axial direction in the closed state. From the valve chamber 34, fuel can flow into a low-pressure region 37 of the fuel injector 1 and from there to the injector return connection 16 when the sleevelike control valve element 35 has lifted from its control valve element seat 38 embodied on the valve body 7, or in other words when the control valve 36 is open. For adjusting the sleevelike control valve element 35 upward in the plane of the drawing, an electromagnetic actuator 39 with an electromagnet 40 is provided, which cooperates with an armature plate 41 embodied in one piece with the control valve element 35 and consequently also cooperates with the sleevelike control valve element 35. When current is supplied to the electromagnetic actuator 39, the control valve element 35 lifts from its control valve element seat 38, which is embodied on the valve body 7 and in this exemplary embodiment is embodied as a flat seat. The flow cross sections of the inlet throttle restriction 30 and outlet throttle restriction 33 are adapted to one another such that when the control valve 36 is open, a net outflow of fuel (control quantity) from the control chamber 29 into the low-pressure region 37 of the fuel injector 1, and from there into the tank 3 via the injector return connection 16 and the return line 17, results. As a result, the pressure in the control chamber 29 rapidly drops, and as a result the injection valve element 18, or more precisely the first part 19, lifts from its injection valve element seat 27, so that fuel from the injector volume 12 can flow out into the combustion chamber through the injection port 15.

For terminating the injection event, the current supply to the electromagnetic actuator 39 is discontinued, as a result of which the sleevelike control valve element 35 is adjusted downward, in the plane of the drawing, on its control valve element seat 38 by means of a control spring 42 that is braced on the armature plate 41. The replenishing fuel flowing through the inlet throttle restriction 30 into the control chamber 29 assures a rapid pressure increase in the control chamber 29 and thus assures a closing force acting on the injection valve element 18. The resultant closing motion of the injection valve element 18 is reinforced by a closing spring 43, which is braced on one end on a circumferential collar 44 of the second part 24 and on the other on a lower, annular face end 45 of the valve body 7.

It can also be seen from FIG. 1 that inside a bore 46 made in the control valve element 35, a loose pressure pin 47 is received, which is embodied as a separate component from the valve body 7. The cylindrical pressure pin 47 has the task of sealing off the valve chamber 34 axially upward, in order to prevent fuel—except for an unavoidable leakage quantity—from the control chamber 29 from being able to flow into the low-pressure region 37 when the control valve element 35 is closed. The pressure pin 47 furthermore serves to guide the control valve element 35 on its inner circumference formed by the bore 46.

As can further be seen from FIG. 1, the fuel injector 1 is a so-called leak-free injector, which except for leakage in the vicinity of the control valve 36 has no leakage, since no permanent low-pressure stage acting in the closing direction on the injection valve element 18 is provided.

As already explained, the first part 19 is guided into the second part 24 of the injection valve element 18 and is guided on the inner circumference of the blind bore 23. Axially between what in the plane of the drawing is an upper face end 48 and the base 49, also upper in the plane of the drawing, of the blind bore 23, a hydraulic coupler volume 50 is embodied, which couples the motion of the parts 19, 24. As also seen from FIG. 1 the coupler volume 50 communicates hydraulically with the injector volume 12 via a throttle arrangement 52 comprising a single throttle bore 51. If current is supplied to the electromagnetic actuator 39 and as a result the second part 24, the upper part in the plane of the drawing, of the injection valve element 18 moves upward in a highly accelerated fashion, then first the pressure in the coupler volume 50 rapidly drops, and because of the suction, the opening force is transmitted to the first part 19, which as a consequence lifts from its injection valve element seat 27. Because of the aforementioned underpressure in the coupler volume 50, the coupler volume increases, since replenishing fuel from the injector volume 12 flows via the throttle arrangement 52 into a region axially between the upper face end 48 of the first part 19 and the base 49 of the blind bore 23. The throttle arrangement 52 is designed such that the filling or increase in the coupler volume 50 does not lead to any functionally relevant change in the maximum stroke of the injection valve element 18. This can also be attained in the event of a multiple injection. The fit between the first part 19 and the inside circumference of the blind bore 23 should be dimensioned such that the volumetric flow occurring here is negligible compared to the flowthrough volume flow through the throttle arrangement 52; thus the guide gap 53 can be described as essentially hydraulically tight.

If the current to the actuator 39 is discontinued, then as mentioned above the pressure in the control chamber 29 rises rapidly, and as a result first the second part 24 of the injection valve element 18 moves axially downward in the plane of the drawing. As soon as the first part 19 is in contact with the injection valve element seat 27, the injection is ended, and the coupler volume 50 is pressed empty by means of the closing spring 43 until the original state is regained. The emptying of the coupler volume 50 is possible only because the throttle arrangement 52 is embodied in such a way that the flowthrough volume flow varies disproportionately little, or in other words not linearly to the increase in the pressure difference between the coupler volume 50 and the injector volume 12. There is no linear relationship, as there is in the case of a conventional guide (lubrication gap theory).

In the exemplary embodiment of FIG. 1, the first part 19 is shaped in the vicinity of the guide gap 53 and is thus embodied as a pivot joint, so that angular errors and skewed positions between the guide on the nozzle end and the guide of the injection valve element 18 in the valve body 7 can be compensated for.

Figure 2:
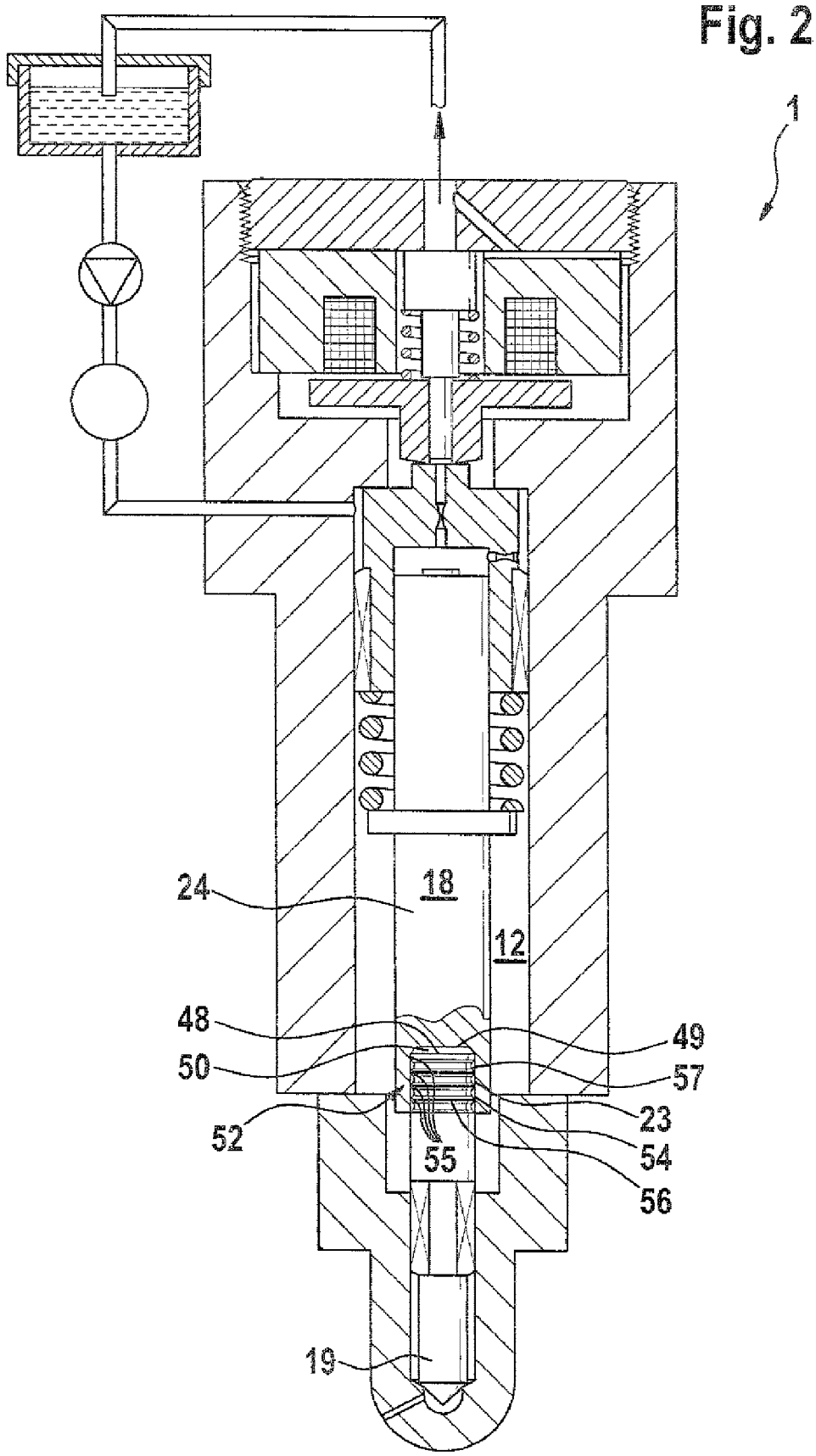

The exemplary embodiment of a fuel injector 1 shown in FIG. 2 is essentially equivalent to the exemplary embodiment of FIG. 1, so that to avoid repetition, reference is made with regard to common features to the above drawing description and to FIG. 1 itself. Below, essentially only the differences from the foregoing exemplary embodiment will be described.

It can be seen from FIG. 2 that a throttle bore for connecting the coupler volume 50 to the injector volume 12 has been dispensed with. The coupler volume 50 is again embodied between the base 49 of the blind bore 23 and the upper face end 48, in terms of the plane of the drawing, of the first part 19 of the injection valve element 18. In the exemplary embodiment shown, the throttle arrangement 52 is realized in the vicinity of a guide 54 between the outer circumference of the first part 19 and the inner circumference of the blind bore 23. In the exemplary embodiment shown, the throttle arrangement 52 includes a number of throttle restrictions 55 disposed axially one after the other. Each of the throttle restrictions 55 is formed between an annular land 56, with an outer edge tapering to a point in the radial direction, and the inner circumference of the blind bore 23. The axial length of the lands 56 in a region located at the inner circumference of the blind bore 23 should be made so short that a turbulent flow can develop, with the consequence that the flowthrough volume flow through the throttle arrangement 52 increases only disproportionately little with an increasing pressure difference between the coupler volume 50 and the injector volume 12. The two annular lands 56 each, adjacent one another in the axial direction, between them define a groove 57 (circumferential groove) on the outer circumference of the first part 19. As in the exemplary embodiment of FIG. 1, in the vicinity of the guide 54 the first part 19 is shaped somewhat spherically, so that the first part 19 is pivotable within certain limits relative to the second part 24 so that angular errors can be compensated for.

The foregoing relates to preferred exemplary embodiments of the invention, it being understood that other variants and embodiments thereof are possible within the spirit and scope of the invention, the latter being defined by the appended claims.

We claim:

1. A fuel injector, in particular a common rail injector, for injecting fuel into a combustion chamber of an internal combustion engine, comprising:

a multi-part injection valve element, which is adjustable between a closing position and an opening position and which includes a first part and at least one second part that is adjustable relative to the first part;

a hydraulic coupler volume, in which the first part and the at least one second part are coupled to one another, with the first part being guided in a guide of the second part, or the second part being guided in a guide the first part; wherein the first part is a control piston that defines a control chamber at one end and said coupler volume at an opposite end, and the second part is a nozzle needle cooperating with a nozzle needle seat; and an injector volume which communicates with the coupler volume via at least one throttle arrangement which is embodied such that a volumetric through flow increases non-linearly with an increasing pressure difference between the coupler volume and the injector volume.

2. The fuel injector as defined by claim 1, wherein the throttle arrangement includes at least one and preferably only one throttle bore, made in particular in the first part or the second part.

3. The fuel injector as defined by claim 1, wherein the throttle arrangement has at least one, in particular hydraulically sharp-edged, throttle stage with a slight length in a flow direction, which is preferably dimensioned such that the throttle stage develops a turbulent flow.

4. The fuel injector as defined by claim 2, wherein the throttle arrangement has at least one, in particular hydraulically sharp-edged, throttle stage with a slight length in a flow direction, which is preferably dimensioned such that the throttle stage develops a turbulent flow.

5. The fuel injector as defined by claim 1, wherein the throttle arrangement includes a plurality of throttle restrictions disposed hydraulically in series.

6. The fuel injector as defined by claim 2, wherein the throttle arrangement includes a plurality of throttle restrictions disposed hydraulically in series.

7. The fuel injector as defined by claim 3, wherein the throttle arrangement includes a plurality of throttle restrictions disposed hydraulically in series.

8. The fuel injector as defined by claim 4, wherein the throttle arrangement includes a plurality of throttle restrictions disposed hydraulically in series.

9. The fuel injector as defined by claim 5, wherein the throttle restrictions are embodied radially between the first and second parts.

10. The fuel injector as defined by claim 6, wherein the throttle restrictions are embodied radially between the first and second parts.

11. The fuel injector as defined by claim 7, wherein the throttle restrictions are embodied radially between the first and second parts.

12. The fuel injector as defined by claim 8, wherein the throttle restrictions are embodied radially between the first and second parts.

13. The fuel injector as defined by claim 5, wherein the throttle arrangement includes a plurality of grooves disposed axially one after the other and made in the first or in the second part.

14. The fuel injector as defined by claim 8, wherein the throttle arrangement includes a plurality of grooves disposed axially one after the other and made in the first or in the second part.

15. The fuel injector as defined by claim 9, wherein the throttle arrangement includes a plurality of grooves disposed axially one after the other and made in the first or in the second part.

16. The fuel injector as defined by claim 12, wherein the throttle arrangement includes a plurality of grooves disposed axially one after the other and made in the first or in the second part.

17. The fuel injector as defined by claim 1, wherein the guide is embodied as a pivot joint that enables a relative adjustability of the first part and second part relative to a longitudinal center axis of the injection valve element.

18. The fuel injector as defined by claim 1, wherein the first part or the second part is shaped spherically in the region of the guide.

19. The fuel injector as defined by claim 1, wherein the fuel injector has no permanent low-pressure stage.

* * * * *